United States Patent [19]

Fry, Jr.

[11] Patent Number: 4,484,697

[45] Date of Patent: Nov. 27, 1984

[54] METHOD AND APPARATUS FOR DISPENSING LIQUID

[75] Inventor: Harry B. Fry, Jr., San Leandro, Calif.

[73] Assignee: Shasta Beverages, Inc., Hayward, Calif.

[21] Appl. No.: 459,705

[22] Filed: Jan. 21, 1983

Related U.S. Application Data

[63] Continuation of Ser. No. 181,914, Aug. 27, 1980, abandoned.

[51] Int. Cl.[3] ..... B65D 35/28

[52] U.S. Cl. ..... 222/95; 222/1; 222/105; 222/386.5; 222/405; 222/263; 222/334

[58] Field of Search ..... 222/1, 95, 96, 105, 222/183, 204, 262, 263, 334, 386.5, 405, 325, 326, 382, 464; 137/565; 251/144, 148

[56] References Cited

U.S. PATENT DOCUMENTS

| | | | |
|---|---|---|---|
| 219,440 | 9/1879 | Boles et al. . | |
| 3,017,883 | 1/1962 | Dickinson | 222/105 |
| 3,171,571 | 3/1965 | Daniels | 222/105 |
| 3,211,349 | 10/1965 | Prussin et al. | 222/464 |
| 4,375,864 | 3/1983 | Savage | 222/105 |

FOREIGN PATENT DOCUMENTS

| | | | |
|---|---|---|---|
| 1255159 | 1/1961 | France | 222/95 |

*Primary Examiner*—H. Grant Skaggs

*Attorney, Agent, or Firm*—Niro, Jager & Scavone Ltd.

[57] ABSTRACT

A method and apparatus for dispensing a liquid efficiently and completely, and in a manner which prevents direct contact with potentially deleterious propellents. The liquid to be dispensed is placed within a collapsible bag having flexible walls and the bag is supported within a container having relatively rigid walls. A source of vacuum pressure is connected to the bag through a flexible conduit and through a weighted connector. The connector defines a port in communication with the conduit and in engagement with and floating in the liquid within the bag. The connector and conduit thereby keep the liquid in constant communication with the vacuum source. Vacuum withdraws the liquid from the bag through the conduit and the port while the connector is maintained in fluid communication with the liquid as the bag collapses as a result of the action of the vacuum force and the weighted connector. Substantially the entire volume of liquid is withdrawn from the collapsing bag, and the connector includes means to assure the continuous flow of fluid through the connector and conduit when the connector engages with the flexible bag.

11 Claims, 19 Drawing Figures

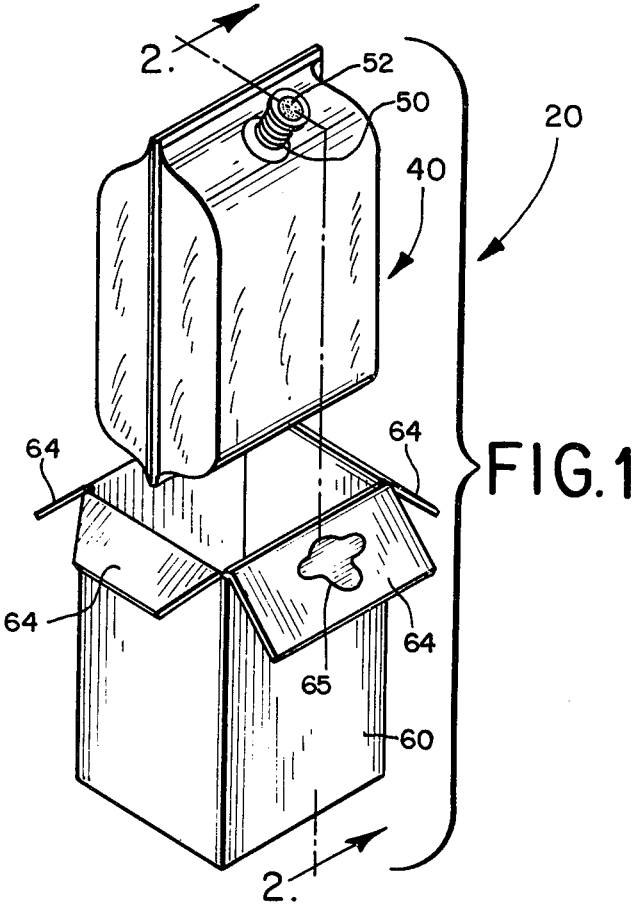
FIG.1
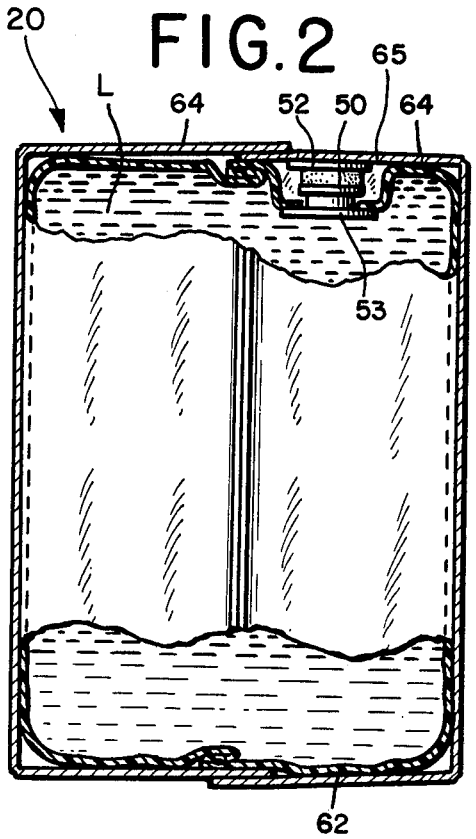
FIG.2
FIG.3
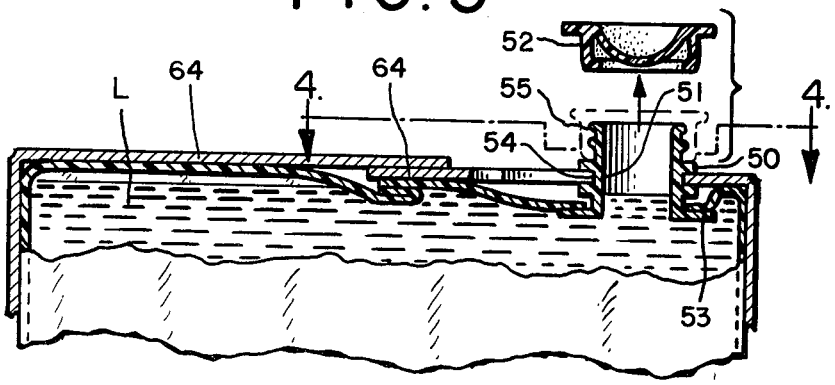
FIG.4
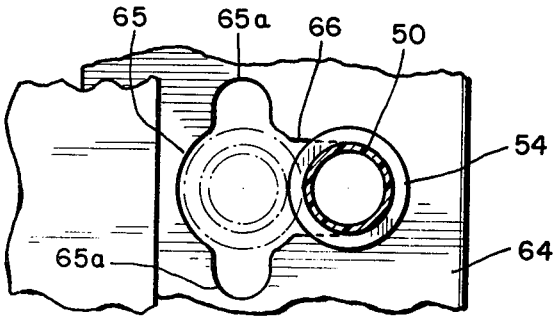

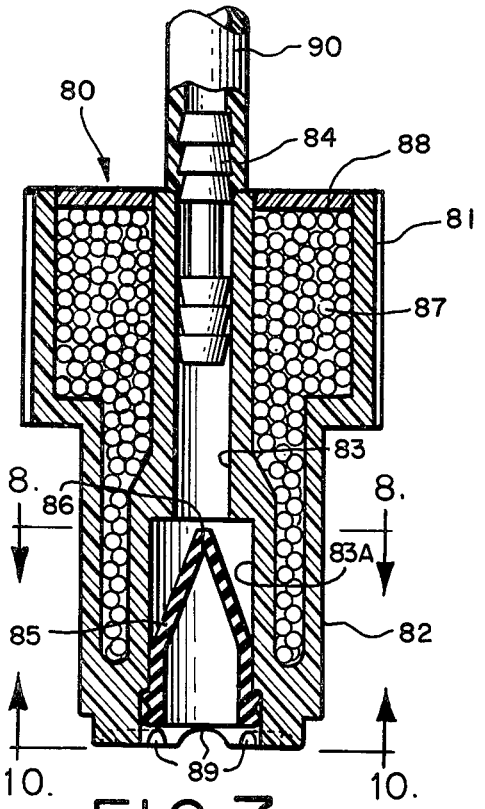
FIG. 7
FIG. 8
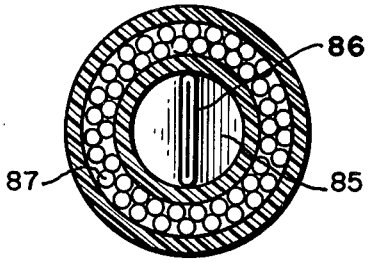
FIG. 9
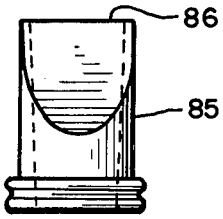
FIG. 10
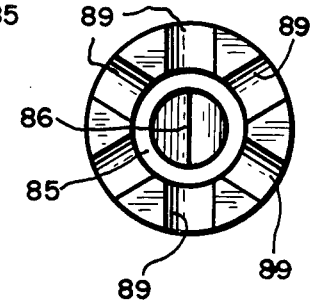
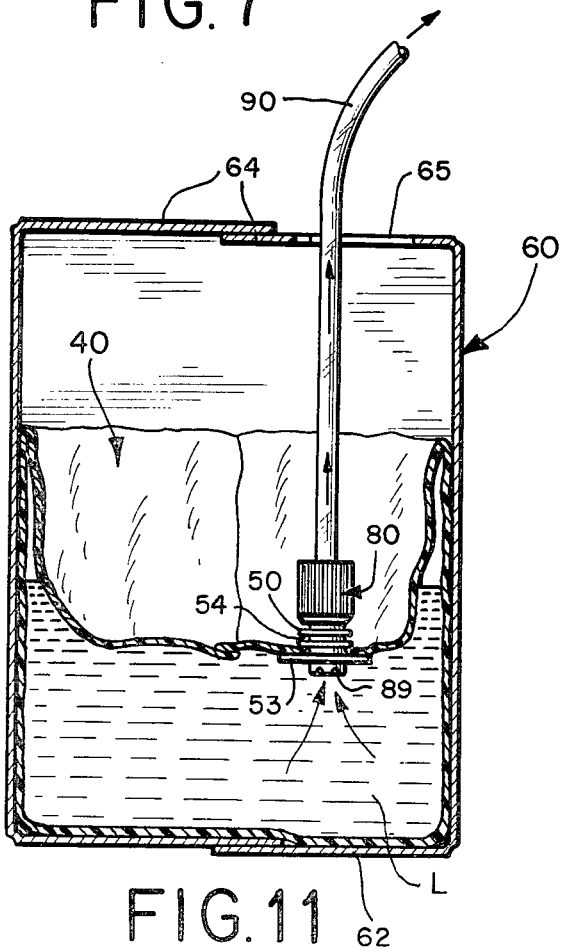
FIG. 11
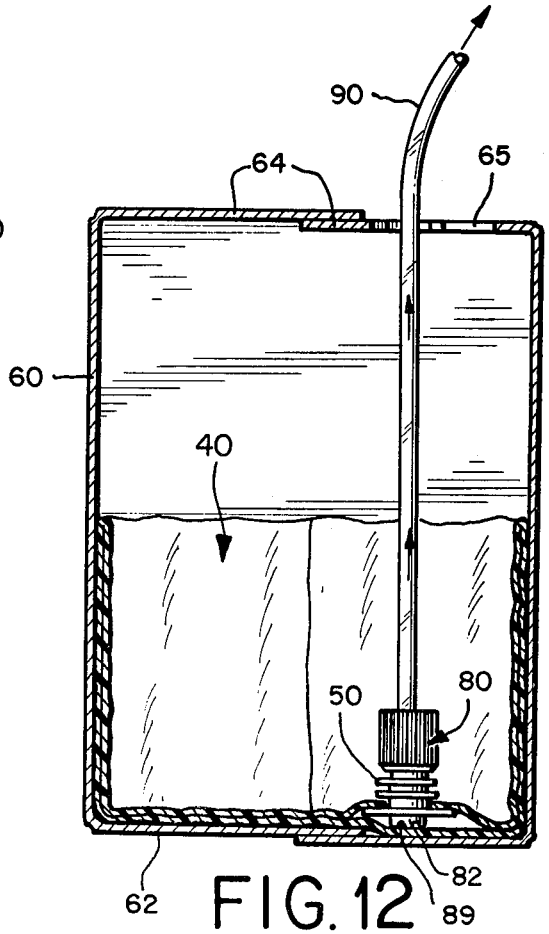
FIG. 12

METHOD AND APPARATUS FOR DISPENSING LIQUID

BACKGROUND OF THE INVENTION

This is a continuation of application Ser. No. 181,914 filed Aug. 27, 1980, now abandoned.

This invention relates to a fluid handling equipment system and more particularly relates to a method and apparatus for transporting, storing and dispensing beverages.

The sale and consumption of beverages has developed into a substantial market. There is a constant effort, because of the volume involved in this market, to develop more efficient and economical systems for storing, transporting and dispensing beverages such as soft drinks. There is also a constant effort to expand the market by providing a system for effectively dispensing other types of beverages, such as wines. These systems must, of course, be sanitary, and must be arranged so that the system can be recharged with beverage or beverage syrup quickly and economically.

One common system presently employed for dispensing beverages involves the use of a pressurized tank. The tank contains a beverage or beverage syrup, and is connected to a source of pressurized fluid, such as carbon dioxide. In the typical installation, the pressurized tank is connected to a dispensing valve and/or a mixing unit, and utilizes the pressure of the carbon dioxide gas to dispense the product. When the tank is empty, it must be removed from the dispensing hookup, stored on location, at least for a period of time, and replaced by a full tank. In many localities, established routemen spend a considerable amount of time, effort and money in replacing and returning empty pressure tanks for such beverage dispensing systems.

This common beverage dispensing system, involving the use of returnable pressure tanks possesses several inherent disadvantages. One obvious disadvantage is the time, expense and effort needed to replace and recharge the empty tanks on a periodic basis. Another disadvantage is that the tank itself must be fairly heavy, and is an expensive item, because it must be capable of withstanding substantial pressure. The heavy tank also is cumbersome to handle, expensive to ship, and requires maintenance.

Furthermore, these systems which use pressurized fluids as a propellent to remove the liquid from a tank, possess the inherent disadvantage of exposing the beverage to the propellent. Since the usual propellent is carbon dioxide, the beverage or syrup is exposed to and has a tendency to absorb the carbon dioxide during the dispensing operation. Thus, the composition and taste of the beverage can be deleteriously affected by the dispensing system. This is particularly disadvantageous when the beverage being dispensed in a still wine, which is substantially degraded by exposure to carbon dioxide.

The principal object of this invention is to overcome the above-noted disadvantages of the system for dispensing beverages employing rechargeable and returnable pressure tanks. In accordance with this invention, the pressure tanks are replaced by a beverage container system and method which provides all of the features of the previous pressure tanks, but which is made from disposable, inexpensive, materials. Moreover, the container system of this invention evacuates or dispenses substantially all of the liquid contained therein by use of vacuum pressure in a manner which does not expose the liquid to the potentially deleterious effects of the propellent.

In addition, the system of this invention is compatible with existing dispensing systems, such as remote post mix systems using pressurized tanks. A relatively simple connection of a relay pump and the disposable container converts the existing system to the new invention. A single air-tight fitting allows the hook up to be completed, compared to the dual hookups used in many prior systems. The disposable container is not pressurized, so there is no need to depressurize the container when changing over from an empty tank to a full tank. The possibility of spillage of the liquid or syrup from the container by pressure venting is thereby diminished. The disposable container is also air-tight before connection to the pump, so that there can be no spillage or contamination during storage or shipment. Shelf life of the liquid in the container is thereby increased. The container of this invention also is preferably square or rectangular in configuration so that it can be conveniently stored or stacked under counters and in other storage areas.

The method and apparatus in accordance with this invention involves the placement of the liquid to be dispensed, such as a beverage syrup or the like, within a collapsible bag having flexible walls. A metallized plastic bag is preferred. This bag is sealed with an air-tight cap after it is filled, and is adapted for being supported within a container, such as a fiberboard box, which has relatively rigid side walls. A relay pump which provides a vacuum source is connected to the bag through a flexible conduit. The conduit, in turn, is joined to a weighted connector which fits in a fluid-tight manner within a port member provided on the bag. In accordance with this invention, this weighted connector engages with and floats on the liquid within the bag. The flexible conduit and the weighted connector thereby keep the liquid in constant communication with the vacuum source through the port member as the liquid is withdrawn. The vacuum and the weighted connector function to collapse the bag and maintain the connector and the flexible conduit in fluid communication with the liquid. Dispensing of the liquid continues as the bag collapses, until substantially all of the liquid is removed from the bag. This dispensing occurs without any contact with potentially deleterious propellents, such as carbon dioxide. Also, the system and method prevents premature breaking of the connection to the vacuum force, which would interrupt the dispensing operation. Finally, the vacuum force carries the liquid to a relay pump, where a pumping force is applied directly to the liquid for propulsion to a mixing valve or the like, without contacting the liquid with a propellent.

ILLUSTRATIVE EMBODIMENT

Further objects and features of the present invention will become more apparent from a description of an illustrative embodiment thereof, taken in conjunction with the accompanying drawings, in which:

FIG. 1 is an exploded perspective view showing the flexible bag and the rigid container incorporated in the liquid dispensing system in accordance with the present invention;

FIG. 2 is an elevational sectional view of the assembled bag and container, as taken along line 2—2 in FIG.

Figure 5:
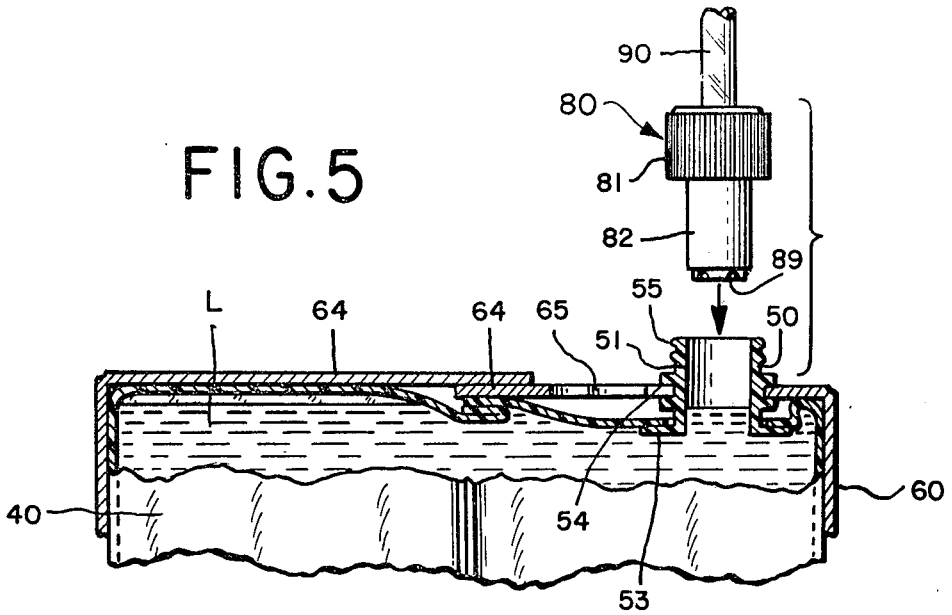
Figure 6:
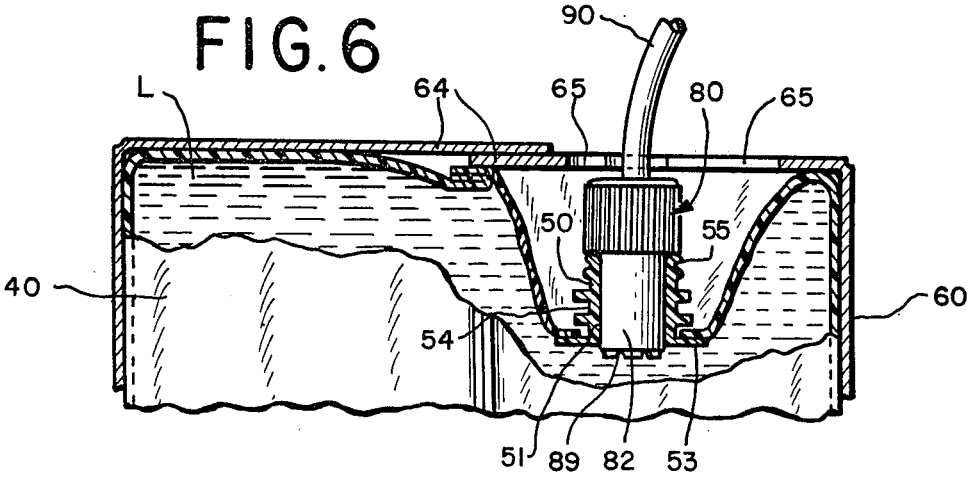
Figure 13:
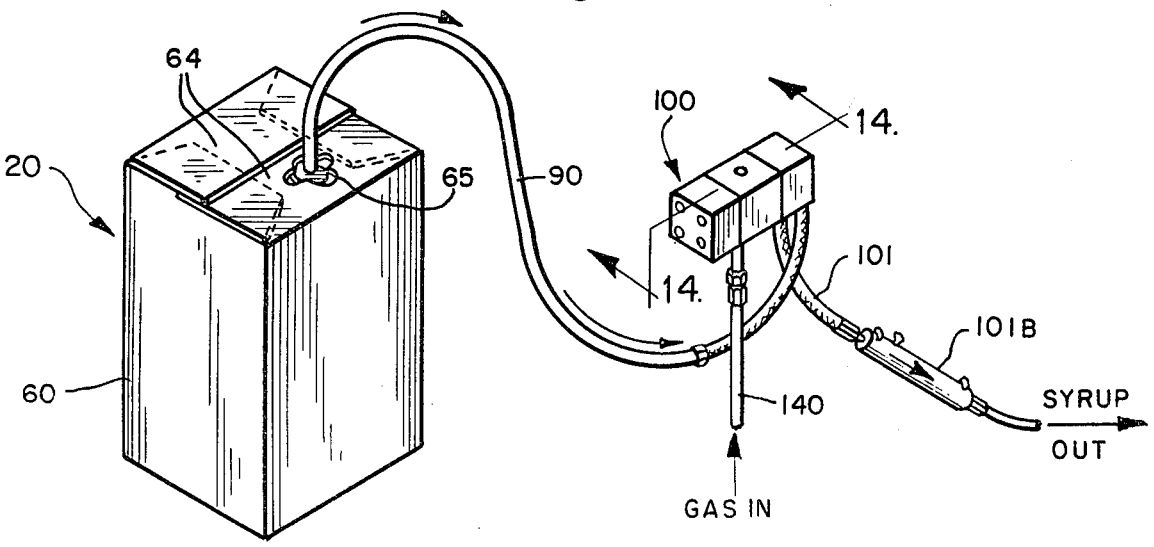
Figure 14:
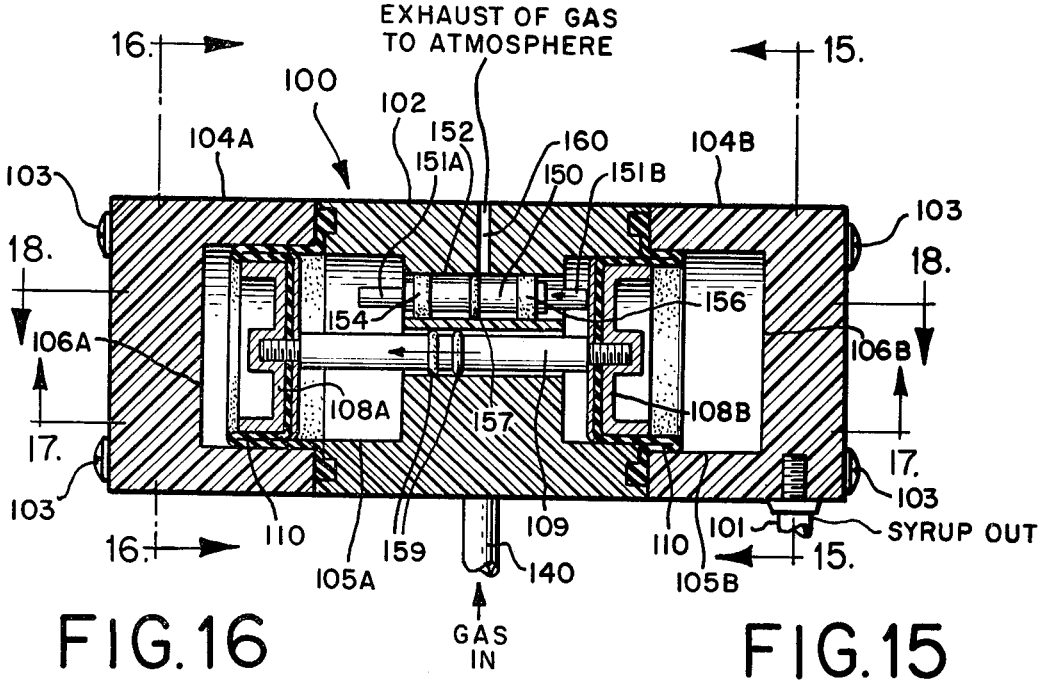
Figure 16:
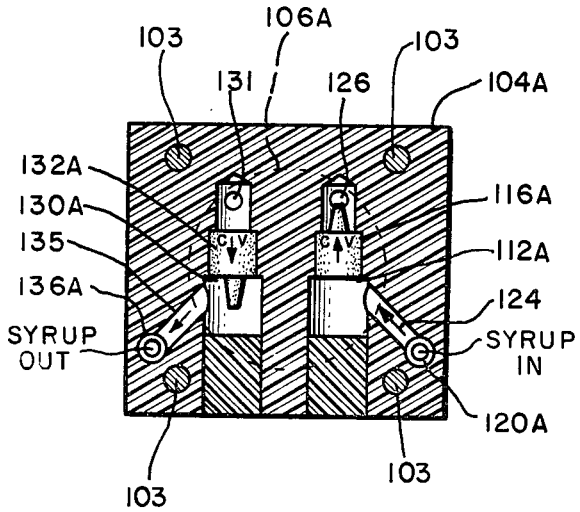
Figure 15:
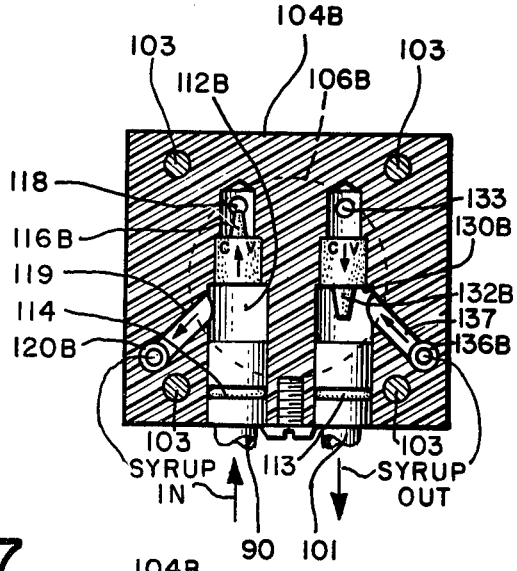
Figure 17:
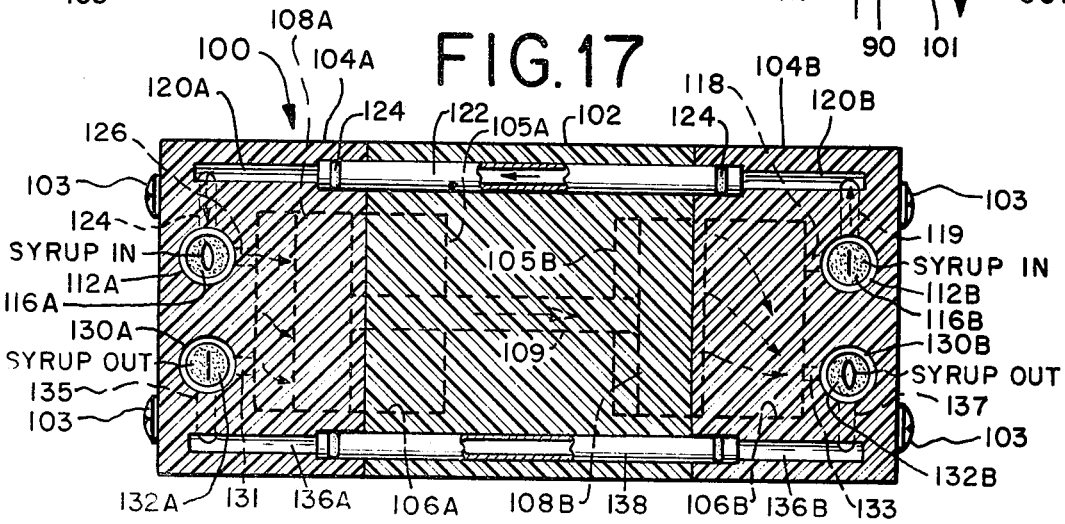
Figure 18:
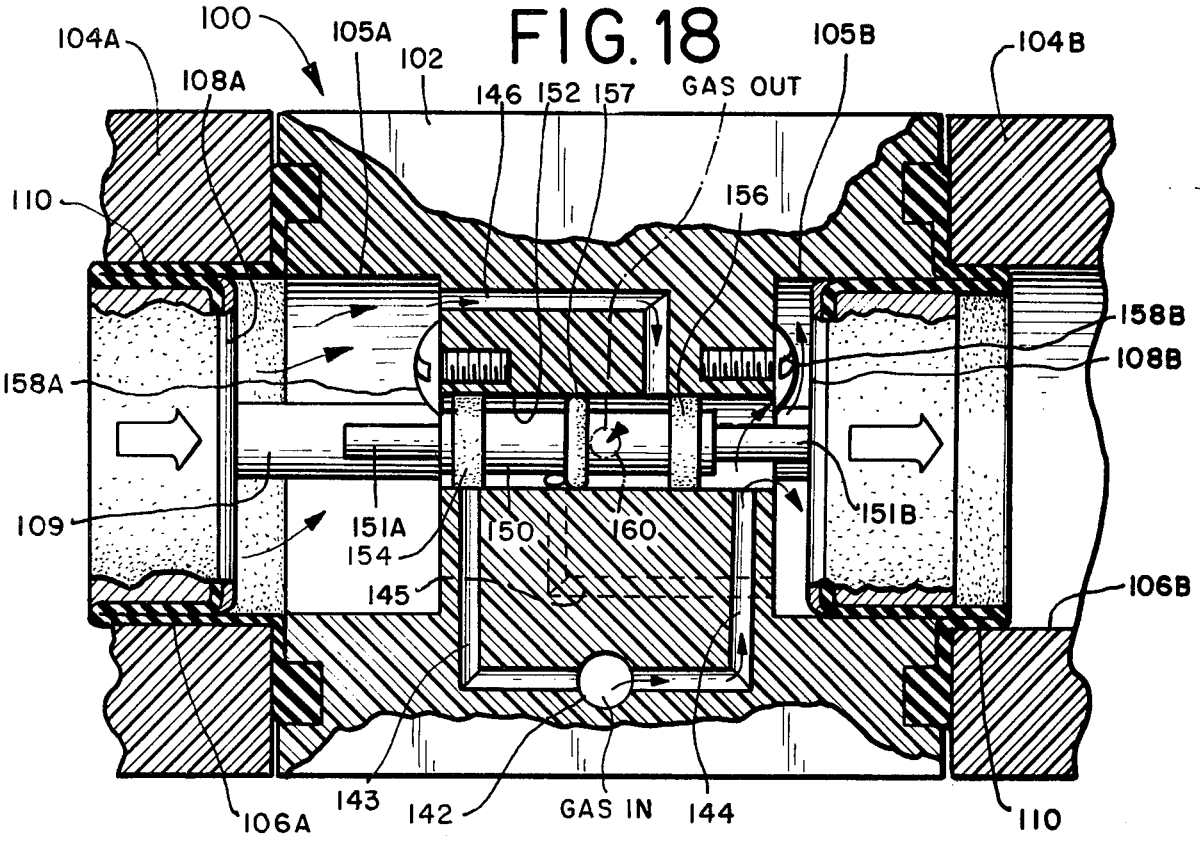
Figure 18A:
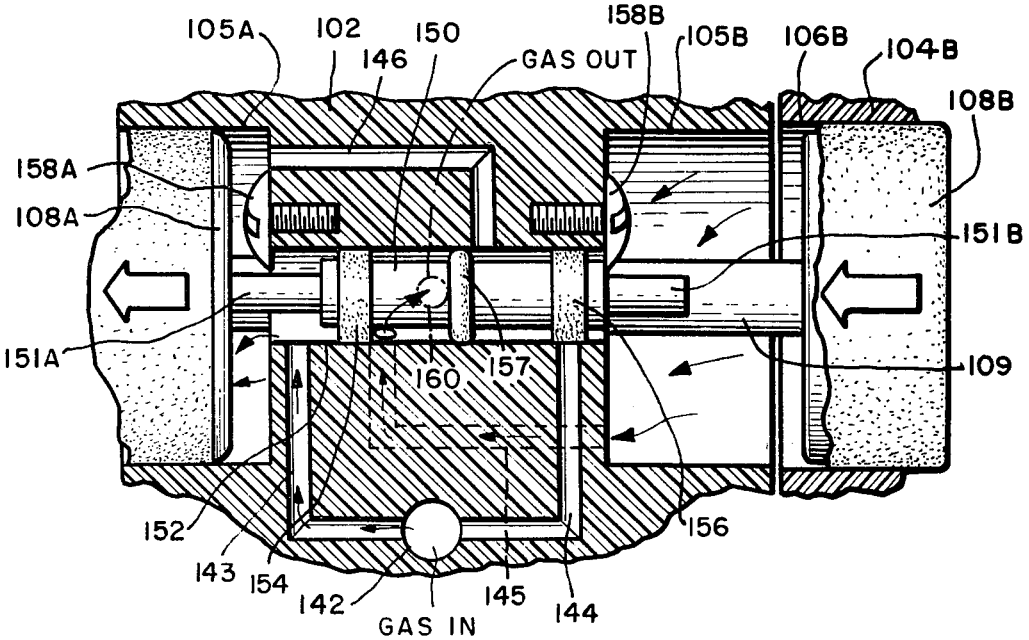

1, with the system shown in a filled and capped condition, and prepared for storage or shipment;

FIG. 3 is an enlarged partial sectional elevational view of the top portion of the bag and container, illustrating the system in an uncapped condition and adapted for connection to a connector and conduit of the liquid dispensing system;

FIG. 4 is a sectional view, taken along the line 4—4 in FIG. 3, showing the slot provided in the container for temporarily positioning the port member on the bag at the top of the container, so that the port can receive the connector;

FIG. 5 is an enlarged partial sectional elevational view of the bag and container, shown with the port member on the bag temporarily secured in a position to receive the connector member, to connect the bag and the liquid therein to a vacuum source;

FIG. 6 is an enlarged partial sectional elevational view of the bag and container showing the positioning of the connector member within the port member on the bag, and the insertion of the port and connector members within the bag in condition to initiate the dispensing operation;

FIG. 7 is an enlarged sectional view of the connector and the flexible conduit which joins the bag to the vacuum source in accordance with the present invention;

FIG. 8 is a cross-sectional view, taken along the line 8—8 in FIG. 7, illustrating the check valve included in the connector;

FIG. 9 is a removed elevational view of the check valve shown in FIGS. 7 and 8;

FIG. 10 is a bottom view of the connector taken along the line 10—10 of FIG. 7, illustrating the flow channels provided in the lower portion of the connector to assure fluid flow from the bag during the entire discharging operation;

FIG. 11 is a cross-sectional view of the bag and container showing the state of the liquid in the bag and the relative condition of the bag and container when the dispensing operation is approximately fifty percent completed;

FIG. 12 is a cross-sectional view of the bag and container shown in FIG. 11, showing the state of the liquid in the bag and the relative condition of the bag and container when the dispensing operation has been substantially completed;

FIG. 13 is a perspective view of the dispensing system in accordance with this invention, showing the flexible conduit connections between the bag and container and the relay pump which withdraws the liquid from the bag by a vacuum force and pumps the liquid to a dispensing valve;

FIG. 14 is a cross-sectional view of the relay pump taken along the line 14—14 in FIG. 13;

FIG. 15 is a cross-sectional view of one end of the relay pump, taken along the line 15—15 in FIG. 14, showing the valving and conduit system for directing the flow of syrup or other liquid through one chamber of the relay pump;

FIG. 16 is a cross-sectional view of the other end of the relay pump, taken along the line 16—16 in FIG. 14, showing the valving and conduit system for controlling the flow of syrup or other liquid through the other chamber of the pump;

FIG. 17 is a cross-sectional view of the relay pump, taken along the line 17—17 in FIG. 14, illustrating the fluid connection between the opposed piston chambers in the relay pump provided by the valving and conduit system;

FIG. 18 is an enlarged partial cross-sectional view of the relay pump, taken along the line 18—18 in FIG. 14, showing the fluid drive system for driving the pump with the opposed pistons beginning a rightward pumping stroke, as viewed in FIG. 18; and FIG. 18*a* is an enlarged partial cross-sectional view of the fluid drive system for the relay pump as shown in FIG. 18, illustrating the condition of the drive system at the start of a leftward stroke for the opposed pistons.

The beverage dispensing system in accordance with this invention is generally referred to by the reference numeral 20. As seen in FIG. 1, the system 20 generally includes a collapsible fluid-tight bag 40 having flexible side walls, and a container 60, having relatively rigid side walls. The bag is preferably made from a high impact metallized material which is clad with inner and outer layers of low density polyethylene. The container 60 is made from high strength fiberboard material. The container 60 preferably is rectangular in shape, to facilitate stacking of the system 20 during shipment, storage and use.

The bag 40 is dimensioned to be received within the container 60 within a close tolerance, such as shown in FIG. 2. The bag 40 is further coordinated with the container 60 so that when the bag is filled with a liquid L, such as shown in FIG. 2, there is a minimum of head space. Thus, motion and other problems resulting from the hydraulic action of the liquid L within the container and the bag during shipment are minimized.

As also seen in FIGS. 1 and 3, the bag 40 has a port member 50 connected to the upper portion of the bag, which defines a port 51 through which the liquid can be dispensed. This port member 50 is sealed to the bag 40 in a fluid-tight arrangement, and receives a removable cap 52 which temporarily seals the port 51. As shown in FIG. 3, the lower portion of the port member 50 includes a flotation ring 53. The ring 53 is secured to the walls of the bag 40, and operates as a flotation collar and stabilizer for the port member 50 by floating on the liquid L contained within the bag 40 as the bag collapses. The outer periphery of the port member 50 defines a circular groove 54, for temporarily receiving a portion of the top wall 64 of the container 60, as shown in FIGS. 3 and 5. The upper edge of the port member 50 also includes a snap ring 55 which engages with and temporarily retains the cap 52 in a fluid-tight arrangement on the port member 50.

As shown in FIGS. 1 through 3, the container 60 includes a pair of bottom end walls 62 and a pair of top end walls 64. One of the top end walls 64 is provided with a generally T-shaped cutout 65. The central portion of the cutout 65 is circular in configuration, and is dimensioned to receive the port member 50. Two side openings 65*a* (FIG. 4) are provided to define finger openings through which the operator of the system can reach downwardly into the container 60, and pull the port member 50 upwardly through the cutout 65. The cutout 65 also includes a retainer slot 66 extending laterally in the top wall 64. The slot 66 is dimensioned so that the groove 54 of the port member 50 will be slideably received in the slot 66. As seen in FIGS. 3 and 4, this arrangement temporarily supports the port member 50 on the wall 64, so that the port 50 can be readily connected to a vacuum source, as explained further below.

FIG. 2 illustrates the bag 40 and container 60 for the system 20 filled with the liquid L and arranged for storage or shipment. In such a condition, the bottom wall 62 and top wall 64 of the container 60 are sealed closed. The port member 50 is inserted inside the container 60 so that the cap 52 rests against the under surface of the top wall 64. The dimensions of the bag 40 and the container 60, and the level of the liquid L, are chosen in the preferred embodiment to define a minimum head space. Thus, problems caused by the hydraulic action of the liquid in the container during movement in storage or shipment are minimized. The generally rectangular shape of the container 60 is more efficient and inexpensive to store and ship than prior cylindrical tanks.

To connect the system 20 for dispensing the liquid L from the bag 40, the system 20 is placed at the desired location, and the port member 50 is withdrawn from the inside of the container 60 through the cutout 65. Then, as seen in FIG. 3, the retaining groove 54 on the port member 50 is engaged with the edges of the slot 66, and the port member 50 is temporarily engaged with the top wall 64 of the container 60. The cap member 52 then can be removed.

Referring to FIGS. 4, 5 and 6, the system 20 is now in condition for receiving a connector 80, for joining the system to a vacuum source. The temporary mounting of the port 50 in the top wall 64 allows the connector 80 to be readily inserted within the port opening 51 by the application of a downward force on the connector. The connector 80 and opening 51 are dimensioned so that the frictional engagement between the parts is fluid-tight.

Once the engagement of the connector 80 and the port member 50 is completed, the connector 80 can be moved laterally from the slot 66 into the circular opening 65 to release the port member 50 from the top wall 64. Then, both the connector 80 and the port member 50 can be forced downwardly into the interior of the container 60 through the circular opening 65. As shown in FIG. 6, this action positions the connector 80 within the port 50 and in contact with the top surface of liquid L in the bag 40. The system 20 is then prepared for beginning the dispensing operation.

As shown in FIGS. 6 and 7, the connector 80 is joined to a flexible conduit 90 which, in turn, is connected to a vacuum source. The vacuum operates to withdraw the liquid from the bag 40 through the connector 80 and the conduit 90.

The detailed construction of the connector 80 is illustrated clearly in FIGS. 7 through 10. The connector 80 includes an upper portion 81 of circular configuration which includes a knurled gripping surface. The upper portion 81 can be gripped firmly, for installing or removing the connector 80 from the port member 50. A lower portion 82 of the connector 80 is concentric with the upper portion 81, and is dimensioned to frictionally fit, in a fluid-tight arrangement, within the port opening 51, as shown in FIG. 6. As shown in FIG. 6, the length of the lower portion 82 is selected so that it extends downwardly beyond the lower edge of port member 50 into contact with the surface of the liquid L. A central opening 83 extends through the connector 80 and permits liquid to pass through the connector and into the flexible vacuum conduit 90. A serrated and hollow hose coupler 84 is frictionally engaged within the conduit 83, as shown in FIG. 7, and extends above the connector 80. The coupler 84 also is frictionally received within the free end of the conduit 90. The conduit 90 is thereby connected to the connector 80, in fluid communication with the central opening 83.

As also shown in FIG. 7, the lower portion 83A of the opening 83 is enlarged to receive a one-way check valve 85. The check valve 85 has a reed-type valve 86 which permits the flow of fluid upwardly in FIG. 7, through the opening 83, in response to upwardly-directed vacuum pressure in the opening 83 and the conduit 90. A reversal of pressure, in the downward direction in FIG. 7, forces the reed valve 86 closed and prevents any downward flow of fluid.

Hence, fluid can flow upwardly through the connector 80 to be dispensed from bag 40, but cannot drain downwardly from the flexible conduit 90. The check valve 85 is most useful in preventing the backflow of the beverage or syrup from the conduit 90 when the connector 80 is removed from an empty bag 40 and is being prepared for connection to a full bag. The change-over from empty to full bags is thus made more efficient and sanitary.

As further seen in FIG. 7, the interior of the connector 80 is hollow, and is provided with a mass 87 which substantially increases the weight of the connector 80. In the illustrated embodiment, the material 87 in the interior of the connector 80 is heavy metal. In other embodiments, the material 87 could be a heavy metal ring or the like. A friction-fitted ring 88 is provided at the top of the connector 80, to retain the weighted material, such as the metal 87, within the connector.

The weight of the connector 80 in accordance with this invention assures that the connector is engaged with and floating on the liquid L within the bag 40, regardless of the level of the liquid in the bag. The opening 83 and the conduit 90 are thus maintained in constant fluid communication with the liquid L.

The end of the lower portion 82 of the connector 80 is provided with fluid passage means to assure that the liquid L will be totally dispensed from the bag 40 during the dispensing operation. In that regard, as shown in FIG. 10, the lower end of portion 82 includes a series of radially extending passageways 89. This passageways 89 connect with the enlarged lower portion 83A of the opening 83 in the connector 80. The purpose of the passages 89 is to permit fluid to flow from the exterior of the connector 80 inwardly into the opening 83 even if the connector 80 is in contact with the collapsed bag 40, such as illustrated in FIG. 12. Continuous fluid flow from the bag 40 into the flexible conduit 90 is thereby assured by this arrangement.

FIGS. 6, 11 and 12 illustrate the operation of the system 20 to dispense the liquid L from the bag 40. When the bag is initially installed at the dispensing location, and the connector 80 is secured to the bag 40, the filled bag 40 assumes the position as illustrated in FIG. 6. The application of a vacuum force to the conduit 90 withdraws the liquid L from the bag 40 through the conduit, as indicated by the arrows in FIGS. 11 and 12. As this withdrawal proceeds, the application of the vacuum force and the weight of the connector 80 and the port member 50 cooperate to maintain the vacuum source, applied through the conduit 90, in direct fluid communication with the liquid L. This is accomplished by the floating of the weighted connector 80 and the port member 50 on the liquid in the bag 40 as the liquid is evacuated. The use of the lightweight flexible conduit 90 allows the conduit and the connector 80 to be drawn into the container 60, and follow the bag 40 as it collapses.

As shown in FIGS. 11 and 12, the flexible side walls of the bag 40 flex and bend, and follow the contour of the interior of the container 60, during this discharging operation. The pressure of the liquid L aids in forcing the collapsing bag to follow the side walls of the container 60. This action prevents the collapsing bag 40 from interfering with the evacuation of the liquid through the port member 50. This collapsing of the bag 40 continues within the container 60 until the the entire volume of liquid L is discharged from the bag 40, as illustrated in FIG. 12. Throughout this operation, this arrangement permits the connector 80, the port member 50, and the coupled conduit 90 to float on and stay in fluid communication with the liquid. The withdrawing vacuum force is not broken, and the flow of liquid from the bag 40 is not interrupted. As shown in FIG. 12, the passages 89 on the lower portion 82 of the connector 80 keep the fluid passages open into the conduit 90, even when the bag 40 is totally collapsed. Substantially total discharge of the liquid L from the bag 40 thus occurs during the dispensing operation.

FIGS. 14 through 18*a* illustrate the details of the preferred form of relay pump 100 for use with the dispensing system 20. The purpose of the relay pump 100, as set forth above, is to withdraw the liquid L from the bag 40 with a vacuum force, and then to apply a pumping force to the liquid, to deliver the liquid to a dispensing valve or the like.

Referring to FIG. 14, the illustrated pump 100 includes a central block 102 and cylinder heads 104A and 104B. Suitable screw fasteners 103 join the heads 104A and B to the adjacent end of the central block 102 in a fluid-tight arrangement. Cylindrical recesses 105A and B in the ends of the central block 102 are in alignment with similar cylindrical recesses 106A and B in the heads 104A and B. The recesses 105A and B and 106A and B thereby define piston chambers for receiving a reciprocating piston having two opposed piston heads 108A and B joined by a connecting rod 109.

As seen in FIGS. 14 and 18, the diameters of the recesses 106A and B are selectively larger than the diameters of the recesses 105A and B. A flexible sleeve seal 110, made from a suitable elastomeric material, thus can be joined to the piston heads 108A and B and be received within the larger recesses 106A and B. The seals 110 also extend between the central block 102 and the cylinder heads 104A and B. The seals 110 thereby divide the chambers defined by the recesses 105A and B and 106A and B into two separate, fluid-tight chambers. As described further below, the chambers 105A and B on the inside of each seal 110 comprise drive chambers for receiving the drive fluid. The chambers 106A and B on the outside of each seal 110 comprise pumping chambers for receiving and pumping the liquid being dispensed.

FIGS. 15 through 17 illustrate the valving system for directing the liquid to be dispensed through the pumping chambers 106A and B. As seen in FIG. 15, a suitable fitting joins the flexible liquid conduit 90 (FIG. 13) to an intake port 112B in the cylinder head 104B. An O-ring seal 114 assures that this connection is fluid-tight. A check valve 116B in the port 112B prevents any back-flow of the liquid into the conduit 90. A bore 118 (FIGS. 15 and 17) joins the port 112B into fluid communication with the pumping chamber 106B through the check valve 116.

The pump 100 also includes a system for directing the liquid to be dispensed into the opposed pumping chamber 106A defined by the head 104A. To accomplish this arrangement, another bore 119 joins the port 112B, downstream from the check valve 116, with a transfer channel 120B defined in the head 104B. A transfer tube 122 is provided in the central block 102 and is sealed by suitable O-rings 124. As shown in FIG. 17, this tube 122 connects the transfer channel 120B in fluid communication with an aligned transfer channel 120A in the head 104A. A bore 124 (FIGS. 16 and 17) joins the channel 120A to a port 112A, downstream from a check valve 116A. Another bore 126 joins the port 112A to the associated pumping chamber 106A. The check valve 116A is arranged to prevent the back-flow of liquid from the chamber 106A into the port 112A. The ports 112A and B and the above described fluid passages will thereby direct liquid into the chambers 106A and 106B in response to the suction or vacuum force created by the reciprocation of the pistons 108A and 108B.

The relay pump 100 also includes a fluid conduit system for directing the liquid from the pump to a dispensing nozzle or the like. In that regard, outlet ports 130A and 130B, including check valves 132A and B, are provided in the cylinder heads 104A and 104B, respectively. Bores 131 and 133 connect the ports 130A and B to the adjacent piston chamber 106A or B. The check valves 132A and B are arranged to open and allow the liquid to be directed out of the pistons chambers 106A and B, but to prevent the back-flow of any liquid into the chambers.

Another set of bores 135 and 137 join the ports 130A and 130B, respectively, to transfer channels 136A and 136B. A transfer tube 138 connects the channels 136A and B so that the liquid discharging from port 130A can be directed into the other port 130B. A suitable fitting with an O-ring seal 139 connects the port 130B to a fluid conduit 101, which preferably includes a surge chamber 101B (FIG. 13). The conduit 101 is connected to a mixing nozzle (not shown) or other dispensing device, to complete the dispensing of the liquid.

The preferred embodiment of the pump 100 is driven by a pressurized fluid such as carbon dioxide. The system for accomplishing this fluid drive is shown in FIGS. 14, 18 and 18*a*, and includes a gas inlet conduit 140, connected to an inlet port 142, and a gas exhaust port 160 vented to the atmosphere. A reciprocating spool valve 150 controls the flow of drive fluid between the inlet port 142 and the exhaust port 160.

Referring to FIGS. 18 and 18*a* in more detail, the inlet port 142 is connected by inlet conduits 143 and 144 to a valve chamber 152 in which the spool valve 150 reciprocates. Valving portions 154 and 156 on the spool valve 150 are arranged to selectively block the communication between the conduits 143 and 144 and the chamber 152, depending upon the position of the valve 150. An exhaust conduit 145 communicates with piston chamber 105B, and an exhaust conduit 146 communicates with piston chamber 105A. An O-ring seal 157 also is provided in a central location on the spool valve 150. The seal 157 co-operates with exhaust conduits 145 and 146 to selectively connect the exhaust conduits to the exhaust port 160 through the chamber 152.

As seen in FIGS. 18 and 18*a*, the end portions 151A and 151B of the spool valve 150 extend laterally a substantial distance, and are arranged for engagement by the adjacent piston 108A or 108B. The action of the pistons 108A and B will therefore cause a corresponding reciprocation of the spool valve 150. Suitable stop means, such as the large-headed screws 158A and B, define the limits for the reciprocation of the spool valve 150. Also, a pair of O-ring seals 159 (FIG. 14) seals the connecting rod 109, to prevent gas leakage past the connecting rod.

The operation of the relay pump 100 begins by the application of a source of constant pressure fluid, such as carbon dioxide or an adequate stable air pressure, to the gas inlet conduit 140 and the inlet port 142. As shown by the arrows in FIG. 18, this pressurized gas will flow through the conduit 144 into the chamber 105B and act upon the rear surface area of the piston 108B. The valve portion 156 on the spool valve 150 seals the chamber 108B from direct fluid communication with the exhaust port 160. The seal 157 also blocks any exhaust of the gas through the exhaust conduit 145. The double-headed pistons 108A and B therefore are driven to the right in FIG. 18 by the pressure of the gas within the chamber 105B.

The continued movement of the pistons to the right eventually engages the piston 108A with the end portion 151A of the spool valve 150. The piston 108A thus causes the spool valve 150 to move to the right, as seen in FIG. 18*a*, until the valving portion 156 blocks the inlet conduit 144. Also, the position of the seal 157 has changed so that the exhaust conduit 145 is now coupled to the exhaust port 160. The flow of pressurized gas to the chamber 105B and the piston 108B is thus blocked, and the gas in the chamber 105B begins to vent to the atmosphere through the exhaust conduit 145 and the exhaust port 160, as shown by the arrows in FIG. 18*a*.

The above-described movement of the spool 150 also positions the valve portion 154 to open the inlet conduit 143, as seen in FIG. 18*a*, so that gas pressure is now applied to the piston 108A in the chamber 105A. At the same time, the exhaustion of the gas through the exhaust conduit 146 and the exhaust port 160 is prevented by the position of the valve portion 154 and the seal 157. The gas thus applies a leftward reciprocating force to the piston 108A in this arrangement. This leftward reciprocation continues until the engagement between the piston 108B and the end portion 151B of the spool valve reverses the operation, and causes the conduit 146 to be coupled to the exhaust port 160 once again (see FIG. 18). Then, the operation is repeated.

Hence, the constant pressure in the conduit 140 and inlet port 142 causes a continuous reciprocation of the double-headed pistons 108A and B. This reciprocation in turn creates a vacuum force which withdraws the liquid L from the bag 40 through the conduit 90, and a pumping force which drives the liquid L through the conduit 140 to a dispensing nozzle or the like.

More specifically, each rightward reciprocatory movement of the pistons 108A and B, as viewed in FIGS. 14 and 17, will draw the liquid L from the conduit 90 into the port 112B and the chamber 106A through the bore 119 and the transfer channels 120A and B and tube 122. At the same time, the pressure on any liquid L in chamber 106B, caused by the rightward movement of the piston 108B, will close the check valve 116B and open the check valve 132B. The piston 108B applies a direct pumping force to the liquid, so that the liquid in the chamber 106B will be dispensed through the port 130B and the outlet conduit 101.

Leftward reciprocation of the pistons 108A and B reverses the operation. The resultant pressure on the liquid in chamber 106A closes the check valve 116A and opens the check valve 132A. The liquid in the chamber 106A will then exhaust to the conduit 101 through conduit 135, the transfer channels 136A and B, and the tube 137. Also, the rightward movement of the piston 108B draws the liquid L into the chamber 106B through the port 112B and the check valve 116B. The reciprocation of the pistons 108A and 108B thus continuously withdraws the liquid L from the conduit 90 and pumps the liquid into the outlet conduit 101. The dispensing of the liquid L thereby occurs smoothly and continuously, without any potentially damaging contact between the liquid and the pressurized dispensing medium such as carbon dioxide.

The relay pump 100 only operates as the beverage product is required. When no product is required the dispensing valve (not shown) connected to the outlet conduit 101 is closed. This creates a back pressure in the conduit 101 and the pump chambers 106A and B. Once this back pressure becomes equalized with the gas inlet pressure in the inlet conduit 140 and in the pump chambers 105A and B, a stall condition is created for the pump. The subsequent opening of the dispensing valve decreases the pressure in the conduit 101 and in the chambers 106A and B, and thereby causes the higher gas pressure in the chambers 105A and B to start the pump operating again. This arrangement thereby eliminates the need for further complicated and expensive pump control equipment.

Although the foregoing specification sets forth an illustrative embodiment of the invention, it will be appreciated by those skilled in the art that modifications and variations can be made to the disclosed dispensing method and apparatus without departing from the scope of this invention, as defined by the following claims.

What is claimed is:

1. A system for dispensing a liquid with a partial vacuum force comprising:

a hollow container having relatively rigid sidewalls;

a collapsible bag supported within said container and having flexible and fluid-impervious walls including top and bottom portions for retaining a liquid to be dispensed;

evacuation port means provided in said top portion of the bag;

a connector member adapted to be removably received within said port means in a fluid-tight relationship and including a lower portion engageable with the liquid within the bag and defining an orifice through which the liquid may be dispensed from the bag; said member further being provided with a selected weight;

flotation means associating with the top portion of the bag and said port means, said flotation means capable of floating the port means and connector member at the surface of the liquid as it is dispensed, wherein the selected weight of the connector member and the flotation means cooperate whereby the selected weight flexes said bag and said flotation means stabilizes the floating connector member to thereby maintain said lower portion in uninterrupted fluid communication with the liquid as the liquid level falls whereby vacuum withdrawal is constant during application of vacuum force;

flexible conduit means joined to said connector member in fluid communication with said orifice for connecting a source of partial vacuum pressure to the interior of said bag for withdrawing said liquid from said bag and wherein the selected weight of the connector member is sufficient to draw said conduit downwardly into said container as said bag collapses;

whereby said system is arranged to withdraw substantially all of the liquid from the bag by maintaining the lower portion of said connector member in constant fluid communication with the liquid as said liquid is being evacuated and as said bag walls collapse in response to flexure by said selected weight and liquid withdrawal by said partial vacuum pressure.

2. A system for dispensing a liquid in accordance with claim 1 wherein said hollow container and bag are arranged so that said bag is filled with liquid and occupies substantially the entire volume of said container to substantially reduce the hydraulic action of said liquid in said bag and thereby stabilize said system and minimize damage to said bag during storage and shipment.

3. A system in accordance with claim 1 wherein said orifice in said connector member is provided with a one-way check valve which prevents liquid in said conduit from re-entering said bag and thereby allows a sanitary disconnection of said member from said bag.

4. A system in accordance with claim 1 wherein said lower portion of said connector member includes fluid passage means allowing withdrawal of said liquid through said orifice with said lower portion in contact with the bottom portion of the flexible bag so that when the bag liquid content is near empty the contact of the lower portion of the connector member with the bottom portion of the bag does not prevent the withdrawal of substantially all of the liquid form the bag.

5. A system in accordance with claim 4 wherein said fluid passage means comprises passageways defined in the lower portion of said connector member.

6. A system for dispensing liquid in accordance with claim 1 wherein said port means comprises a relatively rigid neck member sealed to said top portion of said bag, said neck member defining a port and said flotation means comprises a ring around said neck member and being affixed interiorly of the bag to said top portion thereof, said ring having a selected area for floating on said liquid in said bag to stabilize said neck member and said connector member.

7. A system in accordance with claim 1 wherein said connector member includes an enlarged upper portion to limit the insertion of said connector member into said port.

8. A system in accordance with claim 7 wherein said connector member is hollow and retains a selected weight of substantially heavier material.

9. A system for dispensing a liquid in accordance with claim 1 including vacuum means being operative to withdraw said liquid from said bag without exposing said liquid to a propellent medium which may deleteriously affect said liquid.

10. A method of dispensing a liquid comprising the steps of:

placing the liquid to be dispensed within a collapsible bag having flexible fluid impervious walls including top and bottom portions, and a port member defining an opening through said top portion;

supporting said bag within a container having relatively rigid walls;

connecting a source of partial vacuum pressure to communicate interiorly of the bag by means of a weighted connector engaged with said port member and having an orifice therethrough for liquid withdrawal;

floating said port member and weighted connector in the liquid whereby the partial vacuum source is in fluid communication with the liquid;

withdrawing said liquid from said bag by the application of said partial vacuum force through the orifice of said weighted connector, with said vacuum force and weighted connector cooperating to collapse said flexible bag walls while said walls generally follow the relatively rigid side walls of said container, maintaining said vacuum source in communication with said liquid by floating said connector and port member on said liquid as said liquid is withdrawn and as said bag collapses; and, continuing the withdrawal of liquid to collapse the bag sufficiently to dispose the top portion of the bag and connector at said bottom portion of the bag, and maintaining said connector orifice open to liquid intake, whereby substantially the entire volume of said liquid is withdrawn from said bag without interruption of communication between the partial vacuum source and withdrawing liquid.

11. A method for dispensing a liquid in accordance with claim 10 wherein said liquid withdrawn from said bag is pumped to a selected location remote from said bag by applying a pumping force directly to said liquid without contacting said liquid with a potentially deleterious propellent.

* * * * *